US009550091B2

(12) United States Patent
Emerson

(10) Patent No.: US 9,550,091 B2
(45) Date of Patent: Jan. 24, 2017

(54) SYSTEM AND METHOD FOR CAPTURING EXERCISE DATA

(71) Applicant: Brandon Emerson, Los Angeles, CA (US)

(72) Inventor: Brandon Emerson, Los Angeles, CA (US)

(73) Assignee: Hoofcase, LLC, Los Angeles, CA (US)

( * ) Notice: Subject to any disclaimer, the term of this patent is extended or adjusted under 35 U.S.C. 154(b) by 21 days.

(21) Appl. No.: 14/695,663

(22) Filed: Apr. 24, 2015

(65) Prior Publication Data

US 2016/0310789 A1 Oct. 27, 2016

Related U.S. Application Data

(60) Provisional application No. 61/984,141, filed on Apr. 25, 2014.

(51) Int. Cl.
*A63B 24/00* (2006.01)
*A63B 21/075* (2006.01)

(52) U.S. Cl.
CPC ..... *A63B 24/0062* (2013.01); *A63B 21/075* (2013.01); *A63B 2220/17* (2013.01); *A63B 2220/40* (2013.01)

(58) Field of Classification Search
CPC ... A63B 24/00; A63B 24/0062; A63B 21/075; A63B 2220/17; A63B 2220/40
See application file for complete search history.

(56) References Cited

U.S. PATENT DOCUMENTS

| | | | |
|---|---|---|---|
| 5,048,826 | A | 9/1991 | Ryan |
| 5,468,203 | A | 11/1995 | Okonkwo |
| 6,893,381 | B2 | 5/2005 | Slawinski |
| 6,926,649 | B2 | 8/2005 | Slawinski |

(Continued)

FOREIGN PATENT DOCUMENTS

| | | | |
|---|---|---|---|
| DE | 20303414 | U1 | 10/2003 |
| EP | 2586502 | A1 | 5/2013 |

OTHER PUBLICATIONS www.fitronic.sk/fitrodyne_basic.htm, "FiTRO Dyne Basic—a simple system for the assessment of strength capabilities and feed back monitoring of weight training," website viewed Jan. 8, 2014 (4 pages).

*Primary Examiner* — Glenn Richman
(74) *Attorney, Agent, or Firm* — Wood Herron & Evans LLP

(57) ABSTRACT

The system and method for capturing exercise data may include offsetting an imaginary longitudinal axis of a center beam of a workout bar and an imaginary longitudinal axis of an outer beam of the workout bar. The system and method may include disposing an interface disk between the center beam and the outer beam and may include securing the center beam to an inner disk of the interface disk; securing the outer beam to an outer disk of the interface disk; and moving the inner disk, the outer disk, or a combination thereof, to offset the imaginary longitudinal axis of the center beam and the imaginary longitudinal axis of the outer beam. The system and method may include sensing, dynamically by a sensor, an amount of weight disposed on the outer beam. The system and method may include communicating the amount of weight wirelessly to a computing device.

14 Claims, 15 Drawing Sheets

(56) References Cited

U.S. PATENT DOCUMENTS

| | | | | |
|---|---|---|---|---|
| 7,201,711 | B2 | 4/2007 | Towley, III et al. | |
| 7,666,118 | B1 | 2/2010 | Anthony | |
| 7,819,785 | B2 | 10/2010 | Maiaro et al. | |
| 7,911,339 | B2 | 3/2011 | Vock et al. | |
| 7,942,783 | B2 * | 5/2011 | Ochi | A61H 1/0244 482/1 |
| 7,963,886 | B1 | 6/2011 | Schwinn et al. | |
| 9,408,774 | B2 * | 8/2016 | Rafaeli | A61H 23/0263 |
| 2002/0128127 | A1 | 9/2002 | Chen | |
| 2005/0065003 | A1 | 3/2005 | Klotzki | |
| 2006/0240959 | A1 | 10/2006 | Huang | |
| 2007/0042866 | A1 | 2/2007 | Skilken et al. | |
| 2008/0090703 | A1 | 4/2008 | Rosenberg | |
| 2008/0242513 | A1 | 10/2008 | Skilken et al. | |
| 2011/0112771 | A1 | 5/2011 | French | |
| 2012/0196729 | A1 | 8/2012 | Rafaeli | |
| 2013/0090212 | A1 | 4/2013 | Wang | |

* cited by examiner

| USER ID | WORKOUT ID | SET ID | WEIGHT | REPS | DURATION | INTENSITY | EXERCISE | CALORIES BURNED |
|---|---|---|---|---|---|---|---|---|
| 123 | 1004 | 1 | 90 | 12 | 27.8 | 7 | BENCH PRESS | 47 |
| 123 | 1004 | 2 | 100 | 10 | 25.2 | 6 | BENCH PRESS | 52 |
| 123 | 1004 | 3 | 110 | 8 | 23.0 | 7 | BENCH PRESS | 65 |
| 123 | 1004 | 4 | 60 | 14 | 30.9 | 5 | CURL | 31 |
| 396 | 708 | 1 | 140 | 10 | 29.6 | 4 | BENCH PRESS | 109 |

SYSTEM AND METHOD FOR CAPTURING EXERCISE DATA

Several non-limiting and non-exhaustive exemplary embodiments of a system and method for capturing exercise data are described herein. In accordance with an exemplary embodiment of the invention, a workout logging apparatus or a workout bar may be incorporated into a workout or exercise routine and may facilitate the generation or capture of data relating the underlying exercise. Specifically, the workout bar may include an internal measurement device such as a strain gauge to facilitate the generation and capture of workout or exercise data. The workout bar may be in communication with one or more computing devices for facilitating storage and retrieval of the information.

SUMMARY

In an embodiment of the invention, a method for capturing exercise data is provided. The method includes offsetting an imaginary longitudinal axis of a center beam of a workout bar and an imaginary longitudinal axis of an outer beam of the workout bar. The method further includes sensing, dynamically by a sensor, an amount of weight disposed on the outer beam. The method further includes communicating the amount of weight wirelessly to a computing device.

In an embodiment of the invention, a system for capturing exercise data is provided. The system includes a workout bar comprising a center beam having an imaginary longitudinal axis, an outer beam adapted to receive weight disks thereupon and having an imaginary longitudinal axis, and an interface disk secured between the center beam and the outer beam, wherein the interface disk enables movement of the imaginary longitudinal axis of the outer beam with respect to the imaginary longitudinal axis of the center beam. The system further includes a sensor configured to sense an amount of weight applied to the outer beam. The system further includes a first wireless module configured to wirelessly transfer the amount of weight. The system further includes a computing device comprising a second wireless module configured to wirelessly receive the amount of weight from the first wireless module.

BRIEF DESCRIPTION OF THE SEVERAL VIEWS OF THE DRAWINGS

The accompanying drawings, that are incorporated in and constitute a part of this specification, illustrate various exemplary embodiments of the invention and, together with the detailed description of the exemplary embodiments given below, serve to explain the embodiments of the invention.

Similar numbers refer to similar parts throughout the drawings.

DETAILED DESCRIPTION

Exemplary embodiments of the invention are directed to a system and method for capturing exercise data. The exercise data may be generated by a user performing one or more exercises with a structural element. As such, the structural element may be incorporated into the system and method of the present invention.

An exemplary embodiment of a structural element that may be incorporated into the system and method for capturing exercise data is shown in FIGS. 1-6 and referred to generally herein as a workout logging apparatus 1. In the illustrated exemplary embodiment of workout logging apparatus 1, the workout logging apparatus 1 generally resembles a barbell. However, the illustrated shape of workout logging apparatus 1 is simply for exemplary purposes and is non-limiting. For example, workout logging apparatus 1 may be formed to generally resemble a dumbbell or may be formed to generally resemble any other desired shape.

Figure 1:
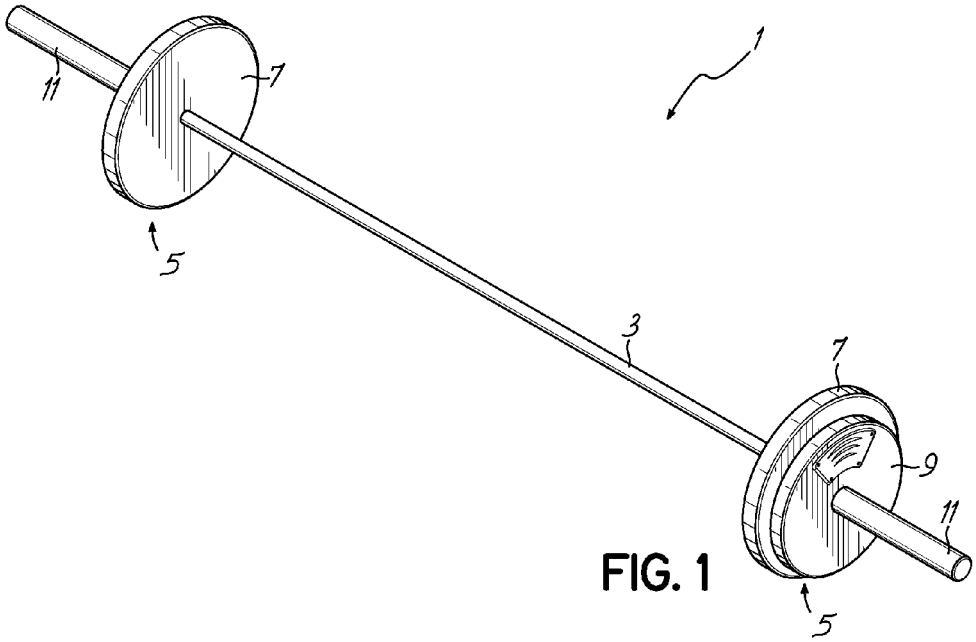
FIG. 1 is a perspective view of an exemplary embodiment of a workout logging apparatus.

As shown in FIG. 1, the exemplary embodiment of apparatus 1 includes a center beam 3 terminating into an interface disk 5. Interface disk 5 is comprised of a first disk and a second disk, referred to hereinafter as an inner disk 7 and an outer disk 9, wherein outer disk 9 includes a slightly smaller diameter with respect to inner disk 7. Inner disk 7 is slightly larger in diameter to provide a sturdy backing and brace for inner disk 7. However, other embodiments of apparatus 1 may omit inner disk 7 altogether or provide inner disk 9 with a smaller diameter with respect to outer disk 9. A set of outer beams 11 extend outwardly away from outer disk 9 in a generally cylindrical shape. Outer beams 11 have an appropriately sized diameter for use in receiving Olympic size weight disks thereon, namely, approximately two inches in diameter. Alternatively, other embodiments of apparatus 1 may include outer beams 11 having an appropriately sized diameter for use in receiving standard size weight disks thereon, namely, approximately one inch in diameter.

Figure 2:
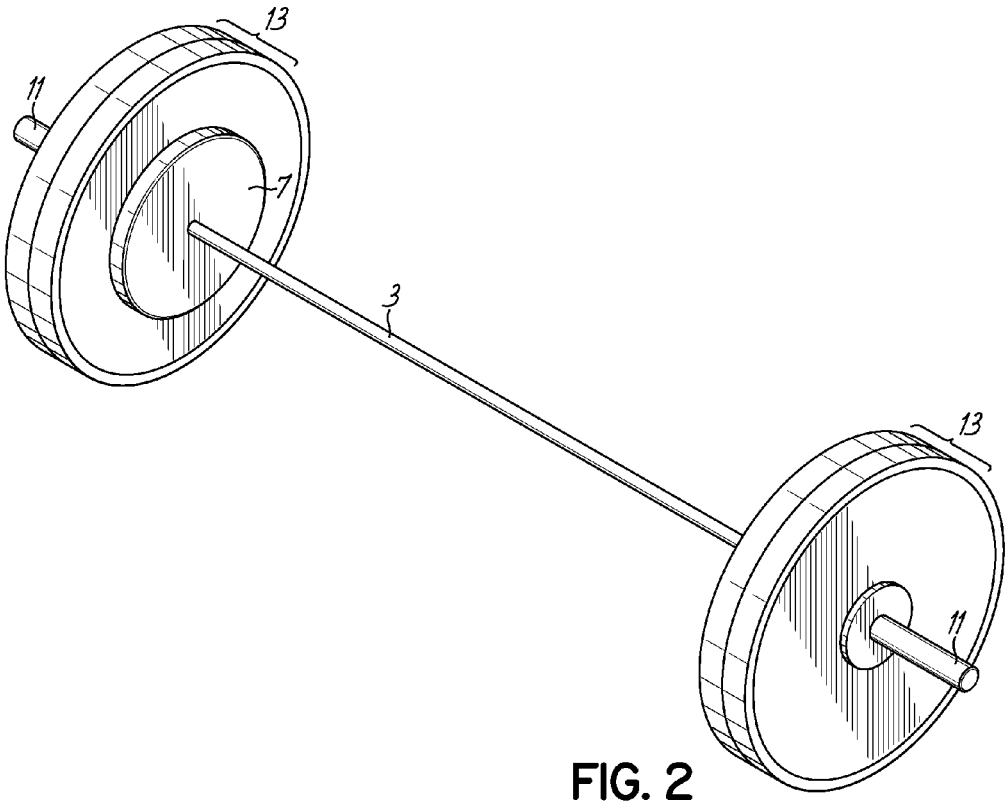
FIG. 2 is a similar view thereof with weight disks disposed on the workout logging apparatus.

As shown in FIG. 2, outer beams 11 are sized and configured to selectively receive a weight stack 13 thereon. Weight stack 13 is typically comprised of common off-the-shelf weight disks. Weight stack 13 includes a user determined amount of weight which corresponds to the aggregate weight of the weight disks loaded onto beams 11. With specific reference to FIG. 2, weight stack 13 includes two 45-pound weight disks disposed on each outer beam 11 which provides a weight of 180 pounds.

Figure 3:
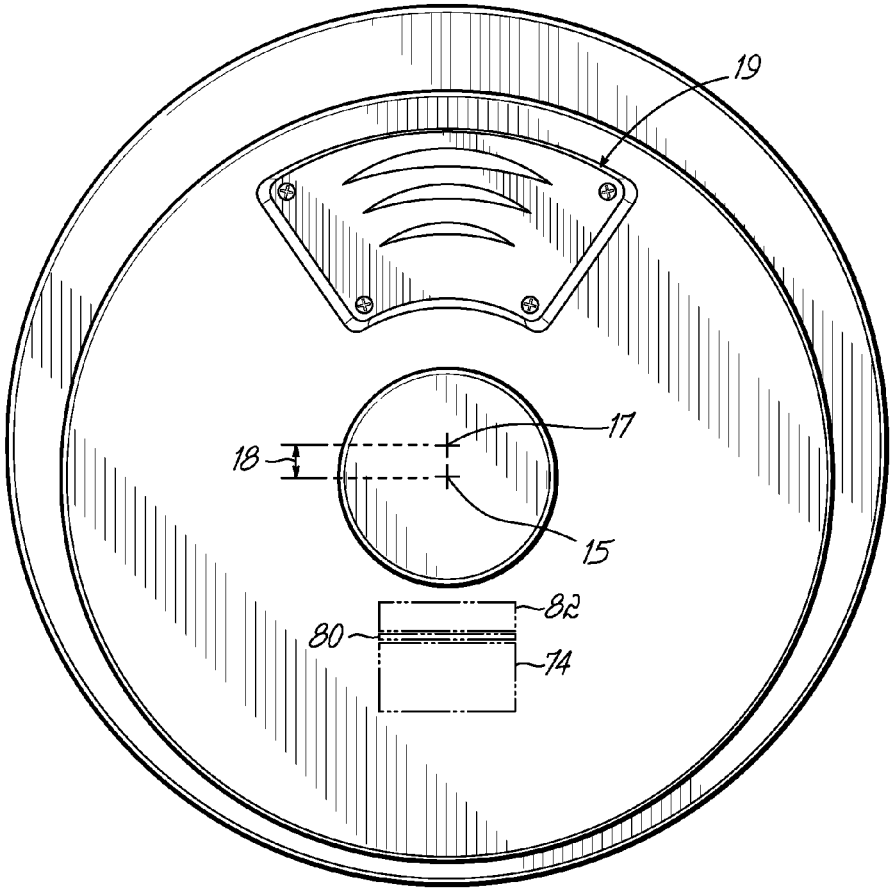
FIG. 3 is a right side elevational view of an end of the workout logging apparatus.

As shown in FIG. 3 outer beam 11 includes an imaginary longitudinal axis 15, which is aligned with the axial center of outer beam 11. When weight stack 13 is applied on outer beam 11, weight disks are evenly distributed around imaginary longitudinal axis 15. Similarly, center beam 3 includes an imaginary longitudinal axis 17, which is illustrated for reference in FIG. 3. Imaginary longitudinal axis 17 is aligned with the axial center of center beam 3, extending along the entire length of center beam 3 parallel to imaginary longitudinal axis 15. As shown in FIG. 3, there exists an offset 18 between axis 15 and axis 17. In accordance with the present invention, offset 18 may be any amount. However, in an embodiment of apparatus 1, offset 18 may be between 0.10 and 0.9 inches between axis 15 and axis 17.

Inasmuch as axis 15 of outer beam 11 is offset from axis 17 of center beam 3, when weight stack 13 is disposed on outer beam 11 and a user grasps center beam 3, the weight of weight stack 13 is drawn by gravity to the lowest possible position within apparatus 1. In one embodiment, the gravitational pull on weight stack 13 and outer beam 11 forces center beam 3 to rotate within the users hand to orient axis 15 and axis 17 along the vertical plane with axis 15 of outer beam 11 spaced apart and vertically below axis 17 of center beam 3. In another embodiment, a system of bearings (not shown) is provided to allow interface disks 5 and/or outer beam 11 to slide or slip to facilitate the gravitational rotation. This eliminates the need for the user to allow center beam 3 to rotate within the user's hands. In one configuration, inner disk 7 is rotatable with respect to outer disk 9 by way of the system of bearings. In this configuration, inner disk 7 is secured to center beam 3 while outer disk 9 is secured to outer beam 11 and offset 18 facilitates outer beam 11 rotating to a vertically lower position with respect to center beam 3.

Figure 4:
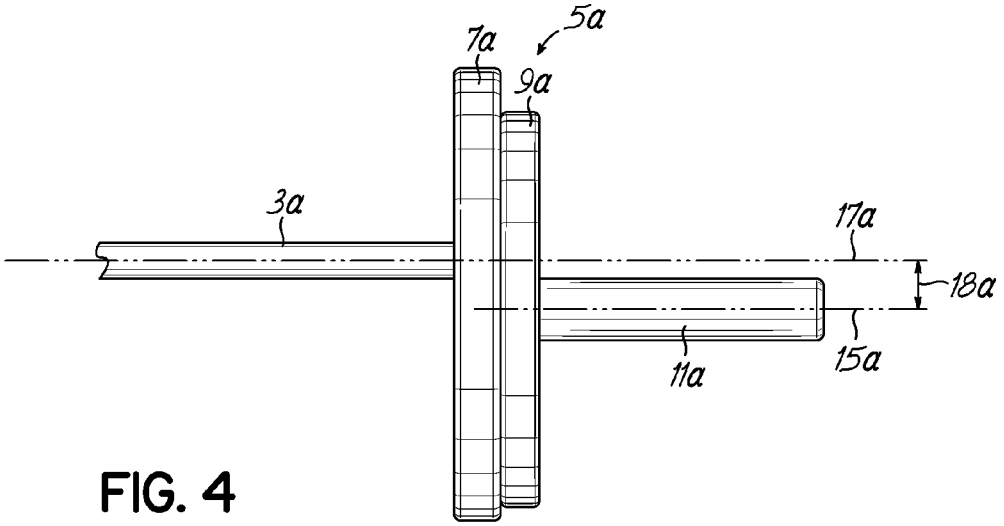
FIG. 4 is a front side elevational view thereof.
Figure 5:
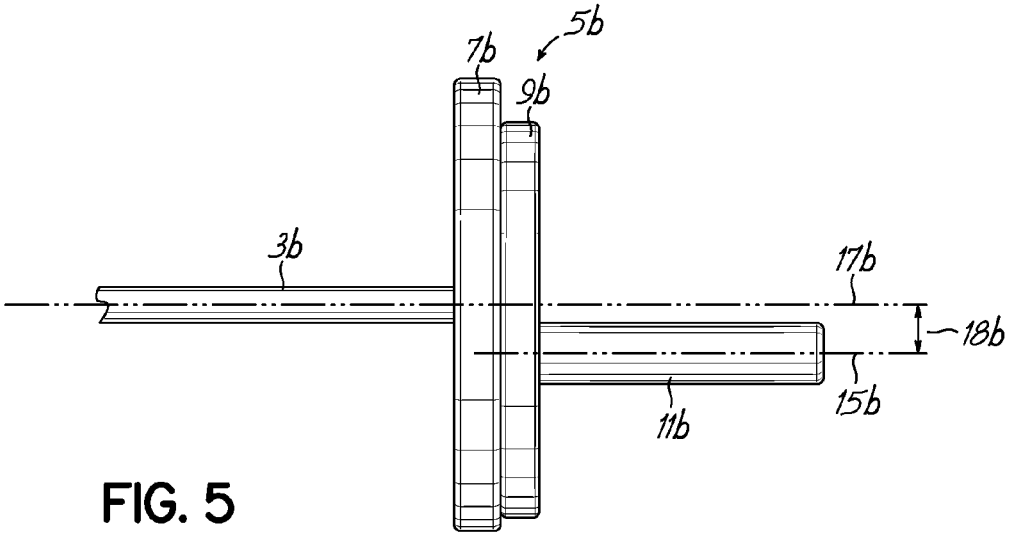
FIG. 5 is a front side elevational view thereof.

As shown in FIGS. 4 and 5, the relative placement of center beam 3 and outer beam 11 may be accomplished by setting axis 15 of center beam 3 to the true center of interface disk 5 and offsetting axis 17 of outer beam 11 accordingly, or alternatively, by setting axis 17 of outer beam 11 to the true center of interface disk 5 and offsetting axis 15 of center beam 3 accordingly. For example, as shown in FIG. 4, axis 15A of outer beam 11A is set to the true center of interface disk 5A. To facilitate offset 18A, axis 17A of center beam 3A is offset from the true center of interface disk 5A. This provides offset 18A with outer beam 11A trued to interface disk 5A. Alternatively, as shown in FIG. 5, axis 17B of center beam 3B is set to the true center of interface disk 5B. To facilitate offset 18B, axis 15B of outer beam 11B is offset from the true center of interface disk 5B. This provides offset 18B with center beam 3B trued to interface disk 5B. In either embodiment of the present invention shown in FIGS. 4 and 5, when a user loads weight stack 13 onto outer beam 11 and lifts apparatus 1 by center beam 3, the gravitational pull on weight stack 13 forces center beam 3 to rotate in the user's hand and dispose axis 15 of outer beam 11 vertically below axis 17 of center beam 3 at a distance of offset 18. Inasmuch as center beam 3, interface disks 5, outer beam 11, and the weights of weight stack 13 are all generally rounded with no relative top and bottom, offset 18 provides apparatus 1 with the feature of a guaranteed and repeatable top and bottom.

Figure 6:
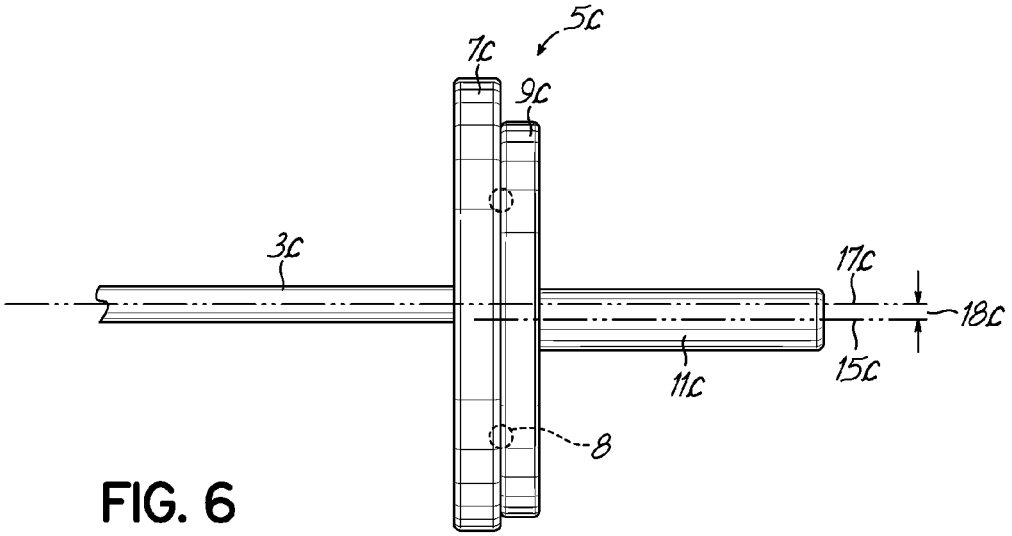
FIG. 6 is a front side elevational view thereof.
Figure 7:
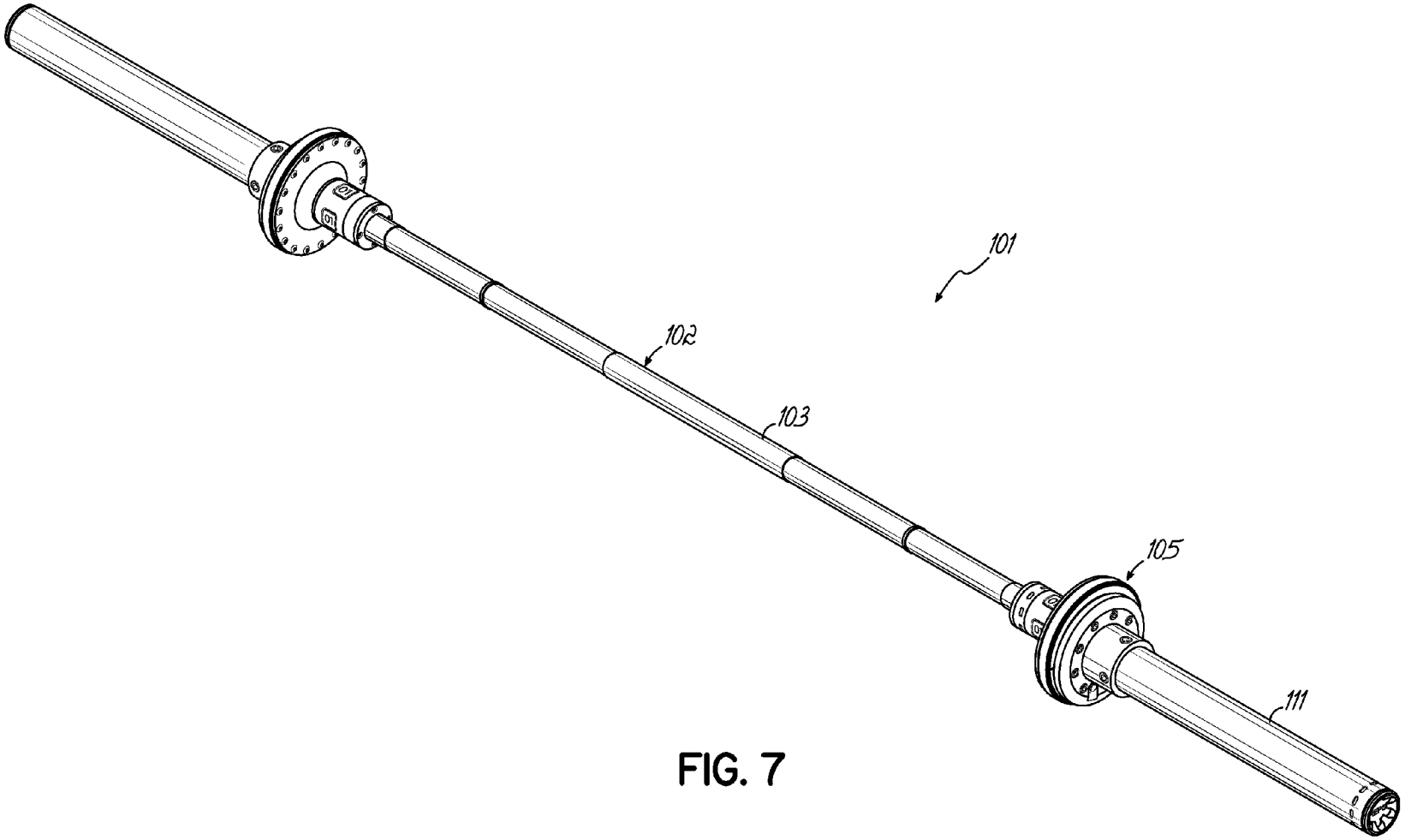
FIG. 7 is a perspective view of an exemplary embodiment of a workout bar of a system for capturing exercise data.

As referenced above, interface disk 5 may be comprised of inner disk 7 and outer disk 9, which may be rotatable about one another to accomplish the rotation of axis 15 to be vertically below axis 17. As shown in FIG. 6, interface disk 5C is provided to facilitate automatic rotation of outer beam 11 to the desired orientation. As such, center beam 3C is secured to inner disk 7C, while outer beam 11 is secured to outer disk 9C. At least one bearing 8 is disposed therebetween to allow inner disk 7C and outer disk 9C to rotate about one another to position axis 15C vertically below axis 17C by an offset of 18C.

As shown in FIG. 3, interface disk 5 includes a sensor assembly 19. Sensor assembly 19 includes a mounting element 74 with a strain gauge 80 applied thereto. The strain gauge 80 is disposed between the mounting element 74 and a pressure element 82 and provides force and weight information to sensor assembly 19 when the pressure between mounting element 74 and mounting element 82 changes. The information may be transferred by way of a set of wires 23. As shown in FIG. 3, strain gauge 80 is disposed generally along an imaginary line 21 extending through axis 15 and axis 17.

In one embodiment of the present invention, sensor assembly 19 may include strain gauge 80, a load cell (not shown), a wireless module (not shown), a control unit (not shown), a power source (not shown), and all required logic circuitry and electronic components (not shown) necessary to connect and configure the aforementioned components of sensory assembly 19. Sensor assembly 19 may also include an accelerometer (not shown). In one embodiment of the present invention, an imaginary line extends through axis 15, axis 17, and through the load cell.

Inasmuch as apparatus 1 provides a guaranteed and repeatable top and bottom while a user is lifting center beam 3, sensor assembly 19 includes a single solitary load cell for dynamically determining the overall weight of weight stack 13. For reference, a load cell is a transducer that is used to convert a force into an electrical signal. In the present invention, the force to be converted is the gravitational pull on weight stack 13, which amounts to the total weight of weight stack 13 and the associated components of apparatus 1. One embodiment of the present invention provides one or more strain gauges in the load cell to measure the gravitational force. Strain gauge load cells are well suited for the present application because they are particularly stiff, have very good resistance values, and tend to have long life cycles in application. Through a mechanical arrangement, the force being sensed deforms one or more internal strain gauges of the load cell. The strain gauges measure the deformation or strain as an electrical signal, because the strain changes the effective electrical resistance of the wire comprising the strain gauge. The electrical signal output is typically in the order of a few millivolts and thus requires amplification by an instrumentation amplifier before it can be used. The output of the transducer can thereafter be scaled to calculate the force applied to the transducer.

The load cell or strain gauge 80 of the present invention is positioned along imaginary line 21 extending through axis 15 and axis 17, which is generally a vertical plane extending parallel to the force of gravity. This positions the load cell in line with the force of gravity on weight stack 13 to facilitate the most accurate determination of the overall weight of weight stack 13 combined with the various other components of apparatus 1. The control unit and logic circuitry are configured to continuously poll the load cell to determine whether there are any changes in the electrical output of the load cell which indicates the overall weight of apparatus 1 has changed. Further, the control unit and logic circuitry are configured to sense a repetitive movement as a workout repetition and to store the sensed number of repetitions and their respective weight in associated variables. This information is available to the user via the wireless module, which is configured to connect to a user's computing device and deliver any logged or sensed data with respect to the user's workout.

In operation, a user approaches apparatus 1 and establishes a communication link between the wireless module of sensor assembly 19 and user's computing device, for example, a smartphone. The communication link may use any standard communication protocol such as Bluetooth®, an implementation of the 802.11 wireless communication protocol, radio frequency identification, infrared communication, or any other form of wireless communication. After a communication link is established, the user uses common off-the-shelf weights to load weight stack 13 on outer beams 11. When this operation is complete, the user then performs an exercise workout using apparatus 1. For each broad movement of apparatus 1, sensor assembly 19, primarily through the load cell, senses the amount of weight and the number of repetitions used during the exercise workout. This information is logged for later retrieval or send directly after capture to the user's computing device.

Apparatus 1 allows for automatic and dynamic calculation and logging of the overall weight of apparatus 1. There are no preset or required weight amounts within apparatus 1. Apparatus 1 is robust in that any amount of weight applied to outer beam 11 by way of weight stack 13 is automatically sensed and stored. Further, apparatus 1 is configured to work with common off-the-shelf components such as standard sized or Olympic sized weight disks. A gym or individual wishing to benefit from apparatus 1 need not purchase any proprietary or custom weights in order to use apparatus 1. The user is able to use any pre-purchased weights with apparatus 1, which provides a dramatic cost savings to the user. The present invention also performs repetition and weight calculations via a minimal number of load cells or strain gauges 80. This is accomplished by incorporating offset axis 18 to create a repeatable and reliable top and bottom within the arcuate components. In turn, this allows apparatus 1 to utilize only a minimal number of load cells or strain gauges 80, as apparatus 1 guarantees the load cells or strain gauges 80 will be properly aligned with the gravitational force when the user lifts apparatus 1. This efficiently is compared to requiring an increased number of load cells because a comparable weight bar would have no set top or bottom to ensure a load cell was properly positioned in line with gravity.

An exemplary embodiment of the system and method for capturing exercise data is shown in FIGS. 7-20 and referred to generally herein as system 101. System 101 includes a workout bar 102 in wireless communication with a computing device 104 (FIG. 9). Workout bar 102 includes a sensor for sensing an amount of weight disposed on the workout bar 102. Computing device 104 may be an off-the-shelf computing component, such as a mobile telephone, laptop computer, a smart watch, or a tablet computer. Similar to apparatus 1, workout bar 102 may be formed in any shape or size and the illustrated workout bar 102 of FIGS. 7-20 is an exemplary non-limiting illustration. The exemplary workout bar 102 of system 101 includes a center beam 103 coupled with an outer beam 111 by way of an interface disk 105. As shown in FIG. 14, interface disk 105 is comprised of an inner disk 107 movably coupled with an outer disk 109.

Figure 8:
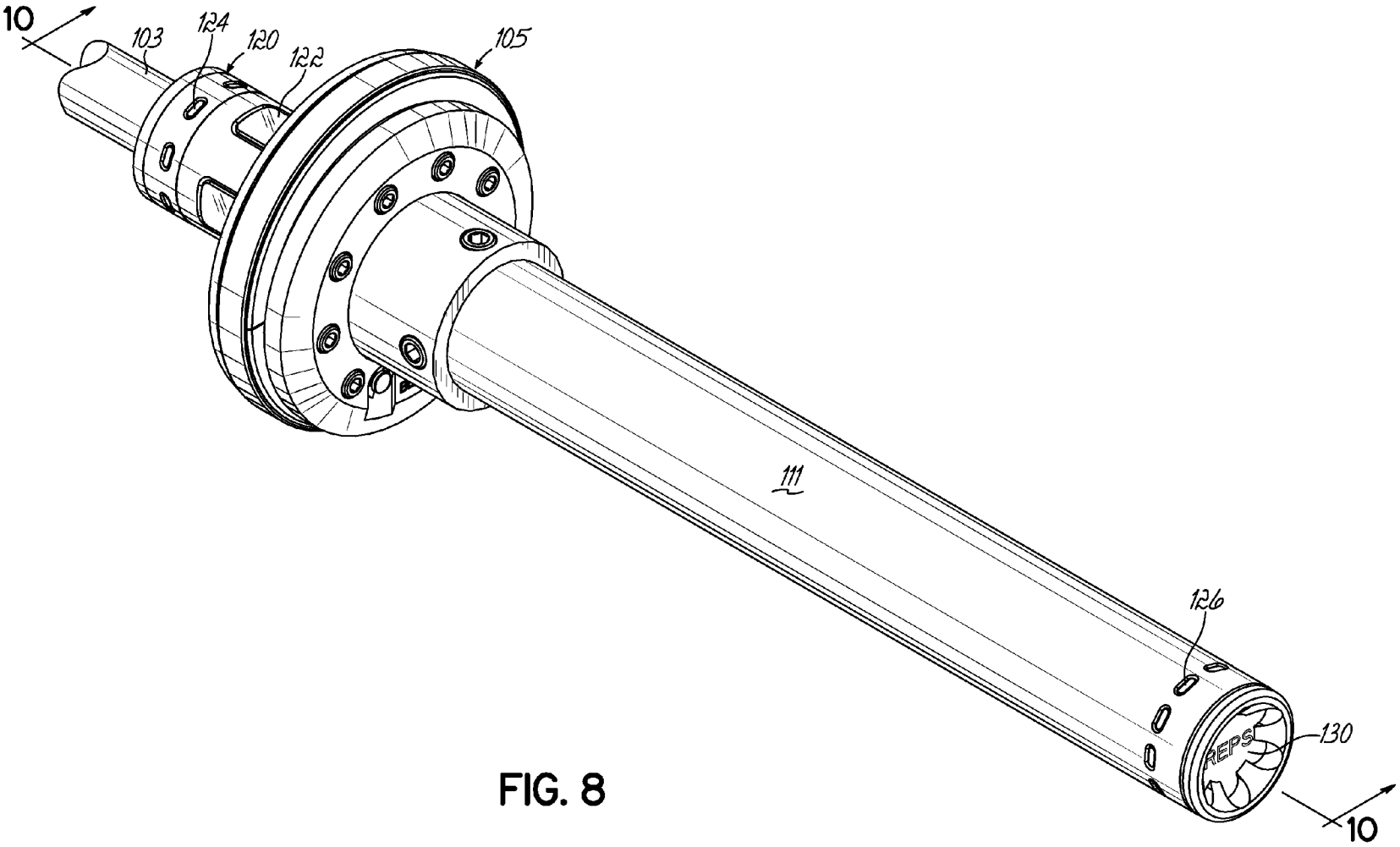
FIG. 8 is an enlarged perspective view of an end of the workout bar.
Figure 9:
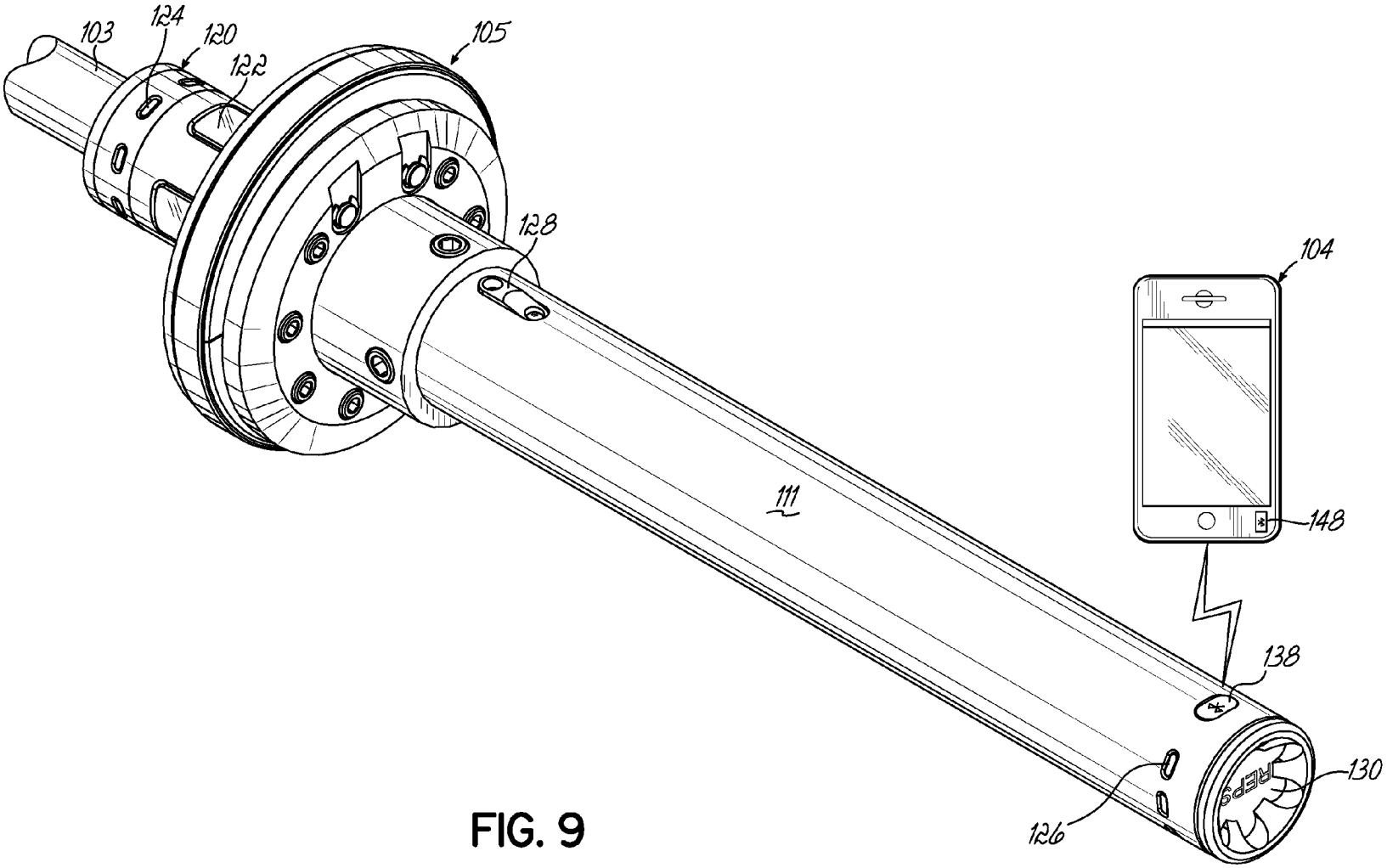
FIG. 9 is the enlarged perspective view of the end of the workout bar and a computing device of the system for capturing exercise data.

As shown in FIGS. 8 and 9, inner disk 107 of interface disk 105 includes a sleeve 120 extending inwardly from inner disk 107 and surrounding a portion of center beam 103. Sleeve 120 includes a digital display 122 and lights 124 viewable around the circumference thereof. Lights 124 may be illuminated to provide feedback to the user regarding whether system 101 is active, or whether a repetition of the workout bar 102 has been registered. Similarly, digital display 122 may be configured to provide feedback to the user regarding the current number of repetitions accomplished, the current overall weight of the workout bar 102, the time elapsed or remaining in a selected workout routine, a combination thereof, or any other feedback the user may desire during a workout. Alternatively, digital display 122 may comprise a colored light to signify to a user of a particular workout bar 102 out of several workout bars 102 in a gym setting. For example, the digital display 122 may project an orange color and likewise computing device 104 may allow the user to select the orange workout bar 102 for interacting therewith. Alternatively, digital display 122 may be replaced with a colored sticker or the like.

Figure 10:
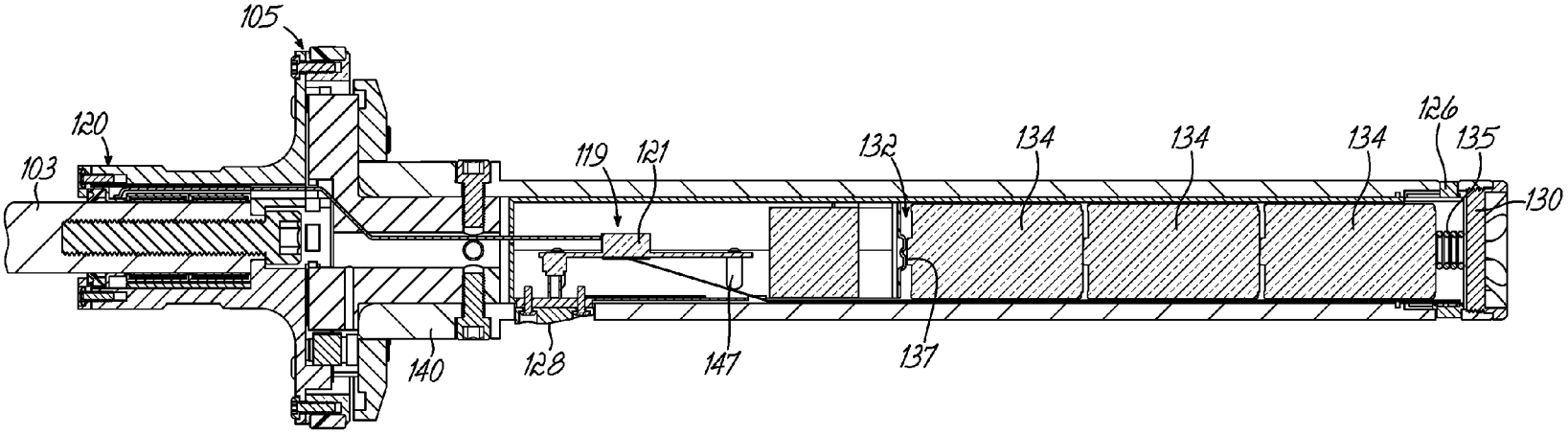
FIG. 10 is a cross-sectional view of the end of the workout bar, taken along line 10-10 of FIG. 8.

As shown in FIGS. 8, 9, and 10, outer beam 111 includes lights 126 disposed around the circumference of the distal end of outer beam 111 and configured to provide feedback to the user about various functions of system 101. Outer beam 111 further includes a cap 130 for selectively sealing a set of batteries 134 in a battery cavity 132 defined by outer beam 111 (FIG. 10). Batteries 134 are oriented to power a sensor assembly 119 disposed throughout interface disk 105 and outer beam 111 by way of a spring 135 extending from cap 130 and a contact 137 at the opposite end of the battery cavity 132. Sensor assembly 119 includes a processor 121 for processing data and logic acquired by elements of sensor assembly 119. Spring 135 and contact 137 represent the ends of a circuit which provides power to sensor assembly 119 when the set of batteries 134 complete the circuit. Inasmuch as a weight lifting user would desire the workout bar 102 to be balanced, the opposite outer beam 111 may either include an adjusted weight to account for the various elements of the outer beam 111 which houses the sensor assembly 119 and the set of batteries 134, or conversely, may include a generally identical internal structure with a matching set of batteries and sensor assembly therein.

Outer beam 111 further includes an actuation switch 128 proximate the outer disk 109 of the interface disk 105. The actuation switch 128 is oriented to be depressed when a weight disk is applied to the outer beam 111 and moved over the actuation switch 128. Depressing the actuation switch 128 actuates the sensor assembly 119. The sensor assembly 119 may be configured to move from a "sleep" to a "wake" mode to prepare for logging a workout, or may activate lights 124 and/or lights 126 to provide feedback to the user that system 101 is engaged.

Outer beam 111 further includes a button 138 disposed on the distal end of outer beam 111. Button 138 may be configured to be manually depressed by a user to initiate the establishment of a wireless communication link between the workout bar 102 and the computing device 104. As such, sensor assembly 119 includes logic and circuitry to initiate a wireless communication link and facilitate a pairing or handshake operation between the workout bar 102 and the computing device 104 when a user manually depresses button 138. For example, the Bluetooth communication protocol may be used to establish a wireless communication link between the workout bar 102 and the computing device 104. As such, the workout bar 102 may include a Bluetooth module 147 logically connected to the sensor assembly 119 or incorporated into sensor assembly 119. Similarly, the computing device 104 may include a Bluetooth module 148 (FIG. 9) disposed therein or otherwise incorporated into computing device 104. Alternatively, workout bar 102 may be configured to beam or transmit exercise data in a stream without a particular computing device 104 paired therewith. The computing device 104 may be configured to read the beamed data for a particular header or data stream signifier alerting the computing device 104 that the underlying exercise data is associated with the user of the workout bar 102 and computing device 104. Upon recognizing that a particular data stream is associated with the appropriate user, the computing device 104 may be configured to read for similar data streams and collect the exercise information for further use by the computing device 104.

Figures 11, 11B, 11C:
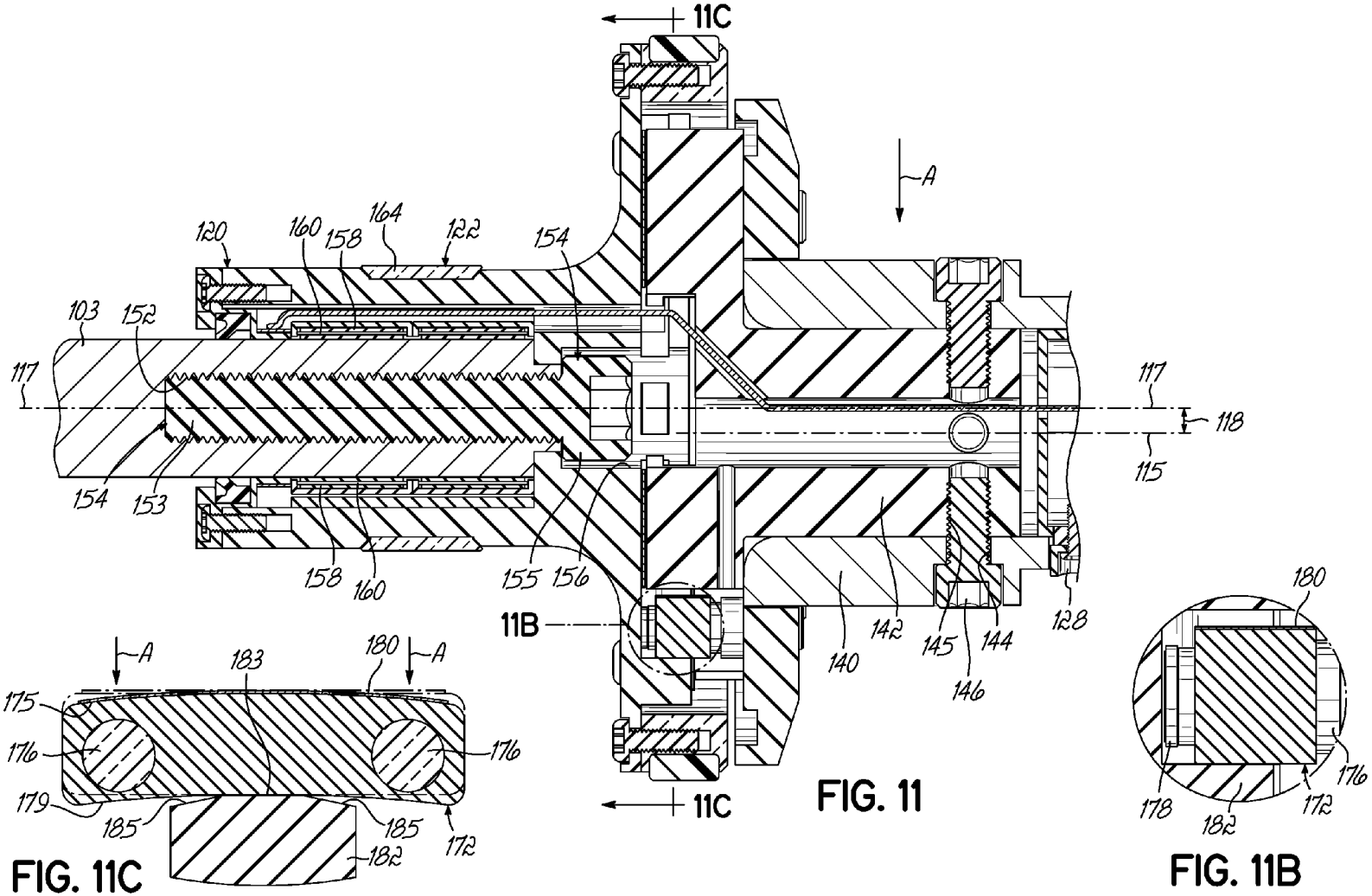
FIG. 11 is an enlarged cross-sectional view of a portion of FIG. 10.
FIG. 11B is an enlarged view of a portion of FIG. 11.
FIG. 11C is a cross-sectional view taken along line 11C-11C of FIG. 11.

As shown in FIGS. 10 and 11, outer beam 111 includes a sleeve 140 sized to fit around a cylinder portion 142 of outer disk 109, which extends therein. A series of apertures 144 are defined by sleeve 140 and align with a corresponding series of apertures 145 to allow fasteners 146 to extend therethrough to secure outer beam 111 to outer disk 109 of interface disk 105.

As shown in FIG. 11, sleeve 120 of inner disk 107 is sized to fit around an end of the center beam 103. Sleeve 120 defines a channel 151 wherein one end of the center beam 103 is disposed. Center beam 103 defines a threaded channel 152 which is configured to receive a threaded portion 153 of a threaded bolt 154 therein. A head 155 of the threaded bolt 154, which includes a smooth outer surface, is disposed in a head chamber 156 which is sized and shaped to allow head 155 to axially rotate therein along with the axial rotation of the center beam 103, as threaded portion 153 is firmly held in threaded channel 152 by way of the threaded connection therebetween.

Figure 13:
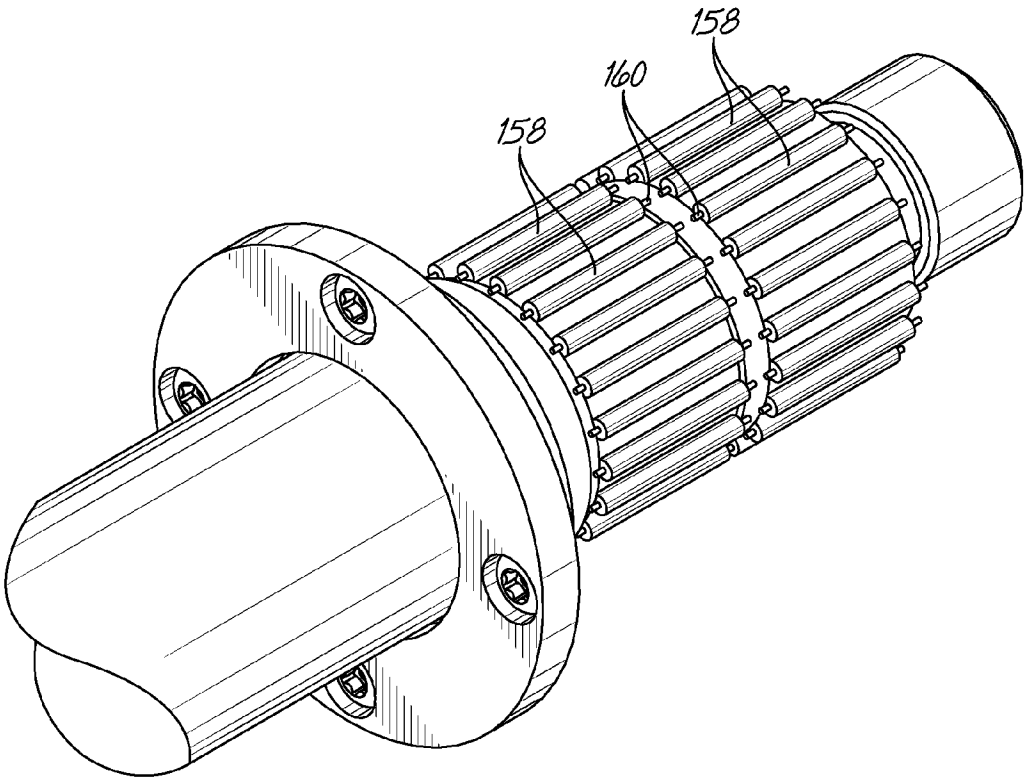
FIG. 13 is a perspective view of the end of the workout bar with parts removed.
Figure 14:
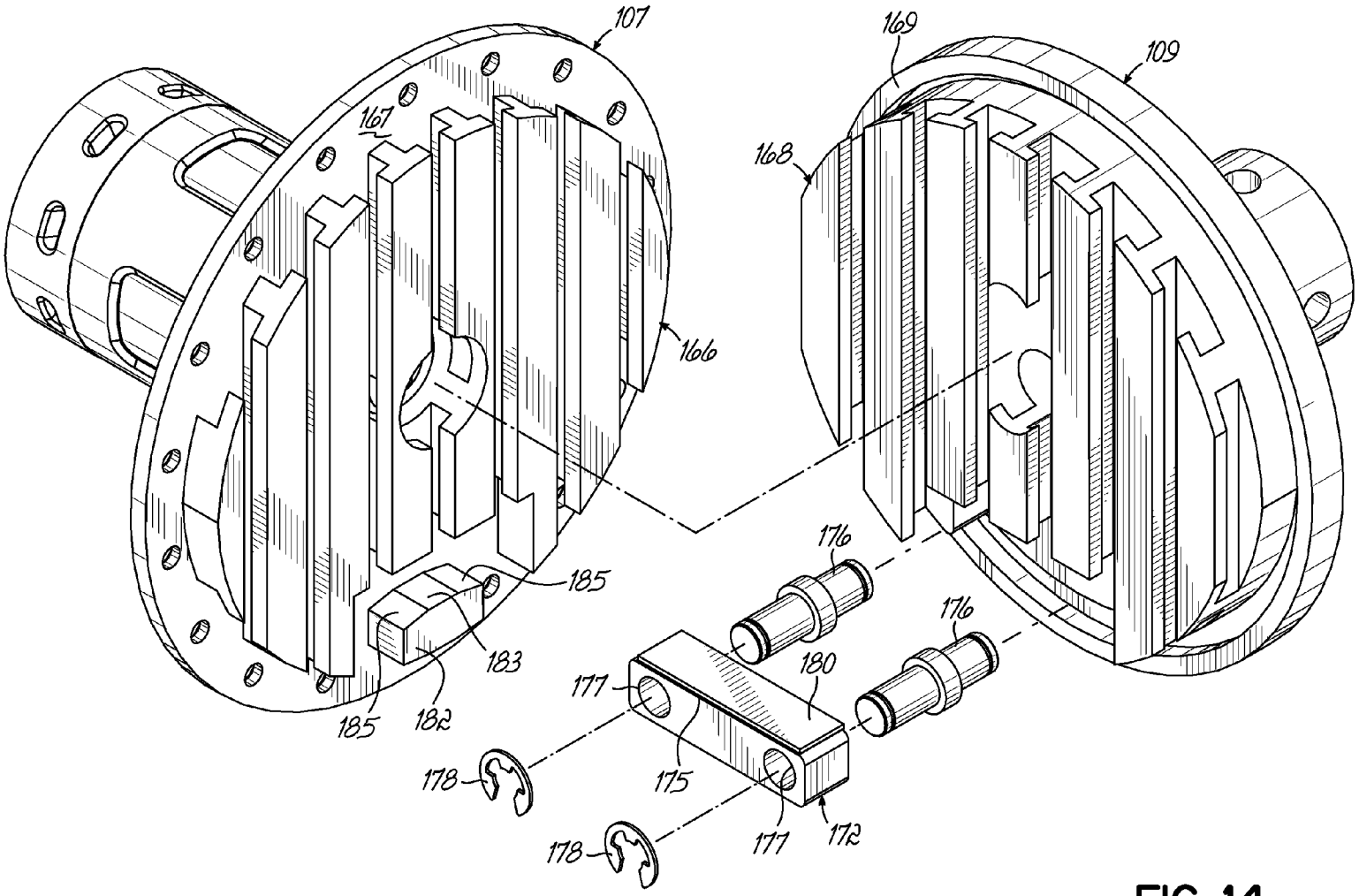
FIG. 14 is an exploded perspective view of an end of the workout bar of FIG. 7 with parts removed.

As shown in FIGS. 11 and 13, sleeve 120 of inner disk 107 includes a plurality of cylindrical roller bearings 158 disposed circumferentially around channel 151. Each bearing 158 is held in place by a pin 160 which is secured to sleeve 120 and facilitates axial rotation of the associated bearing 158 within channel 151. FIG. 13 illustrates inner disk 107 with portions of sleeve 120 removed to more clearly show the shape and orientation of cylindrical roller bearings 158 and pins 160. The plurality of cylindrical roller bearings 158 cooperate to allow efficient axial rotation of the end of center beam 103 disposed in channel 151. An elastomeric brace or gasket 162 may be provided around the entrance to channel 151 to help stabilize center beam 103 therein without restricting the axial movement of outer beam 103 in channel 151.

As discussed previously, sleeve 120 includes a digital display 122. Digital display 122 is comprised of a screen 164 with various display logic circuitry 165 electronically connected to sensor assembly 119. Digital display 122 may be configured to provide feedback to the user with regards to the number of repetitions in the current set and/or the amount of weight applied to the overall workout bar.

Figure 12:
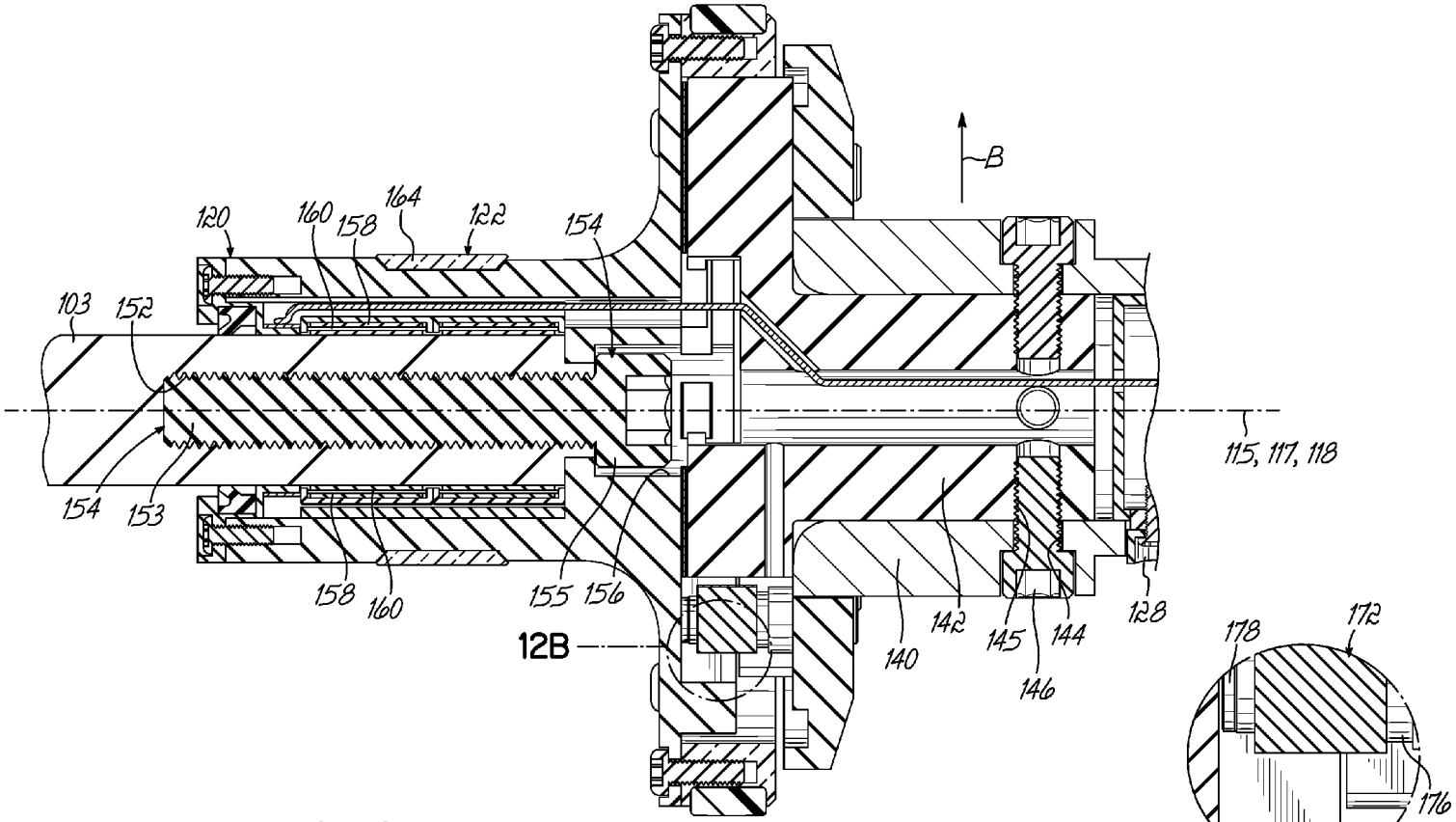
FIG. 12 is an enlarged cross-sectional view of a portion of FIG. 10.

As shown in FIG. 14, interface disk 105 is configured to allow inner disk 107 and outer disk 109 to slide linearly with respect to one another. In the embodiment shown in FIG. 14, each disk is provided with a set of cooperating rails to lock the inner disk 107 and the outer disk 109 together in a sliding engagement. Specifically, inner disk 107 includes a first set of rails 166 which are generally T-shaped and extend outwardly from a disk wall 167 of inner disk 107 from the base of the "T". Similarly, outer disk 109 includes a second set of rails 168 which are generally T-shaped and extend outwardly from a disk wall 169 of outer disk 109 from the base of the "T". The first set of rails 166 interlace with the second set of rails 168 to lock inner disk 107 to outer disk 109 in a linear sliding engagement. As such, outer disk 109 is free to slide in a linear first direction and an opposite second direction with respect to inner disk 107. As shown in FIG. 11, the first direction, referred to hereinafter as the downward direction, is indicated by Arrow A. As shown in FIG. 12, the second direction, referred to hereinafter as the upward direction, is indicated by Arrow B. Inasmuch as outer beam 111 is secured to outer disk 109, outer beam 111 also slides in the linear upward direction and the opposite downward direction with respect to inner disk 107. Similarly, inasmuch as center beam 103 is secured to inner disk 107 by way of threaded bolt 154, center beam 103 also slides in the linear upward direction and the opposite downward direction with respect to outer disk 109 and outer beam 111.

As shown in FIG. 11, outer beam 111 includes an imaginary longitudinal axis 115 extending along an axis of outer beam 111. Center beam 103 includes an imaginary longitudinal axis 117 extending along an axis of center beam 103. An offset 118 exists between axis 115 of outer beam 111 and axis 117 of center beam 103. As shown in FIGS. 11 and 12, offset 118 changes when the outer disk 109 moves in the upward direction and the downward directions.

As shown in FIGS. 11C and 14, a measurement bridge 172 is secured to disk wall 169 of outer disk 109. Measurement bridge 172 includes a first block 174 having a top surface 175 and a bottom surface 179 (FIG. 11C). First block 174 is secured to disk wall 169 by way of a pair of fasteners 176 extending through a matching pair of apertures 177 defined by first block 174. The fasteners 176 are received into disk wall 169 on one end with a locking disk 178 secured to the opposite end to hold the first block 174 thereon. Measurement bridge 172 further includes a sensor 180 for sensing an amount of weight disposed on outer beam 111. In one exemplary embodiment of the system and method for capturing exercise data, the sensor 180 may comprise a strain gauge, an accelerometer, or both. For exemplary purposes, sensor 180 is referred to hereinafter as strain gauge 180. Strain gauge 180 is disposed on top surface 175 of first block 174 and is logically connected to sensor assembly 119 by way of the appropriate wiring (not shown). Strain gauge 180 may be firmly secured to top surface 175 of the first block 174 by an adhesive, a lamination, or any other mechanism for securing strain gauge 180 to top surface 175.

As shown in FIG. 14, a second block 182 is disposed on inner disk 107 and projects outwardly away therefrom. Second block 182 includes a top surface 183 which may include one or more beveled portions 185. Second block 182 is disposed proximate a cavity 187 defined by top surface 183 and portions of the first set of rails 166 extending from disk wall 167. Cavity 187 is sized to receive measurement bridge 172 therein and provide a space for movement of measurement bridge 172 in the upward and downward direction therein.

As shown in FIGS. 11, 11B, 11C, 12, and 12B, measurement bridge 172 may move in the upward and downward direction within cavity 187 due to the linear engagement of the first set of rails 166 of the inner disk 107 with the second set of rails 168 of the outer disk 109. As shown in FIG. 11C, when the measurement bridge 172 moves in the downward direction, as indicated by Arrow A, the bottom surface 179 of the first block 174 abuts the top surface 183 of the second block 182. As the downward force on outer disk 109 increases, either by weights being applied to outer beam 111 or by the movement of an exercise using workout bar 102, measurement bridge 172 flexes due to the downward force and the firm abutment with second block 182. Beveled portions 185 of top surface 183 of second block 182 aid in the flexing of the measurement bridge 172. Inasmuch as strain gauge 180 is secured or connected with the top surface 175 of first block 174, strain gauge 180 flexes due to weights on outer beam 111 or due to the movement of the workout bar 102. Sensor assembly 119 is configured to sense the flexing of strain gauge 180 and collect exercise data therefrom. In the exemplary embodiment of the system and method for collecting exercise data shown in FIG. 11, the strain gauge 180 is configured to sense the axial strain on the measurement bridge 172. In another exemplary embodiment (not shown), the strain gauge 180 is configured to sense the shear strain within interface disk 105.

For example, if a user adds weight disks on each outer beam 111 of workout bar 102, the downward pressure on outer disk 109 increases, which presses measurement bridge 172 more firmly onto second block 182. First block 174 flexes, which in turn flexes strain gauge 180. The amount of flexing and timing of the flex generates data which is captured by sensor assembly 119. This exercise data is provided to computing device 104 for storage and manipulation thereby. Similarly, when a user performs a repetition of an exercise, the movement of workout bar 102 is measured through the flexing and non-flexing of the strain gauge 180 due to the pressure of measurement bridge 172 on second block 182.

Figure 12B:
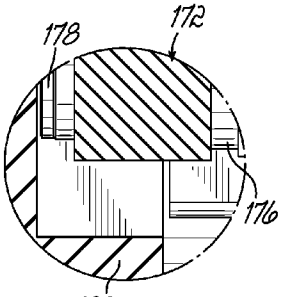
FIG. 12B is an enlarged view of a portion of FIG. 12.

FIGS. 12 and 12B illustrate the orientation of measurement bridge 172 where a minimal amount of weight is applied to outer beam 111. Imaginary longitudinal axis 115 of outer beam is generally in line with imaginary longitudinal axis 117 of center beam 103, thereby minimizing offset 118. As shown in FIG. 12B, measurement bridge 172 is spaced apart from second block 182 and therefore strain gauge 180 is generally non-flexed and horizontal. FIGS. 11 and 11B illustrate the orientation of measurement bridge 172 where an amount of weight is applied to outer beam 111 and/or a repetition is undergoing the upward stroke or upward rebound motion associated with the repetition. For example, FIGS. 11 and 11B may illustrate the orientation of the measurement bridge 172 during the upward push a user exerts when doing a bench press exercise. Due to gravitational forces acting on outer disk 109 and the linear movement facilitated through first set of rails 166 engaged with second set of rails 168, offset 118 increases, measurement bridge 172 abuts second block 182, and strain gauge 180 flexes accordingly. The flexing of strain gauge 180 provides sensor assembly 119 with data regarding the exercise currently being performed with workout bar 102. This data is captured by sensor assembly 119 and provided to computing device 104. In an embodiment of sensor assembly 119, logic circuitry in sensor assembly 119 is configured to continuously poll strain gauge 180 to acquire workout data. Processor 121 accumulates and transforms the data into quantified measurements regarding a workout, including sets, repetitions in each set, the amount of weight in each repetition, and the time and intensity of the repetition and set. The measurements are then provided to the user by way of digital display 122 as well as providing these measurements to computing device 104. Alternatively, the raw exercise data may be provided wirelessly from workout bar 102 to computing device 104, and the computing device 104 may perform the transformation of the raw data into the quantified measurements.

Figure 15:
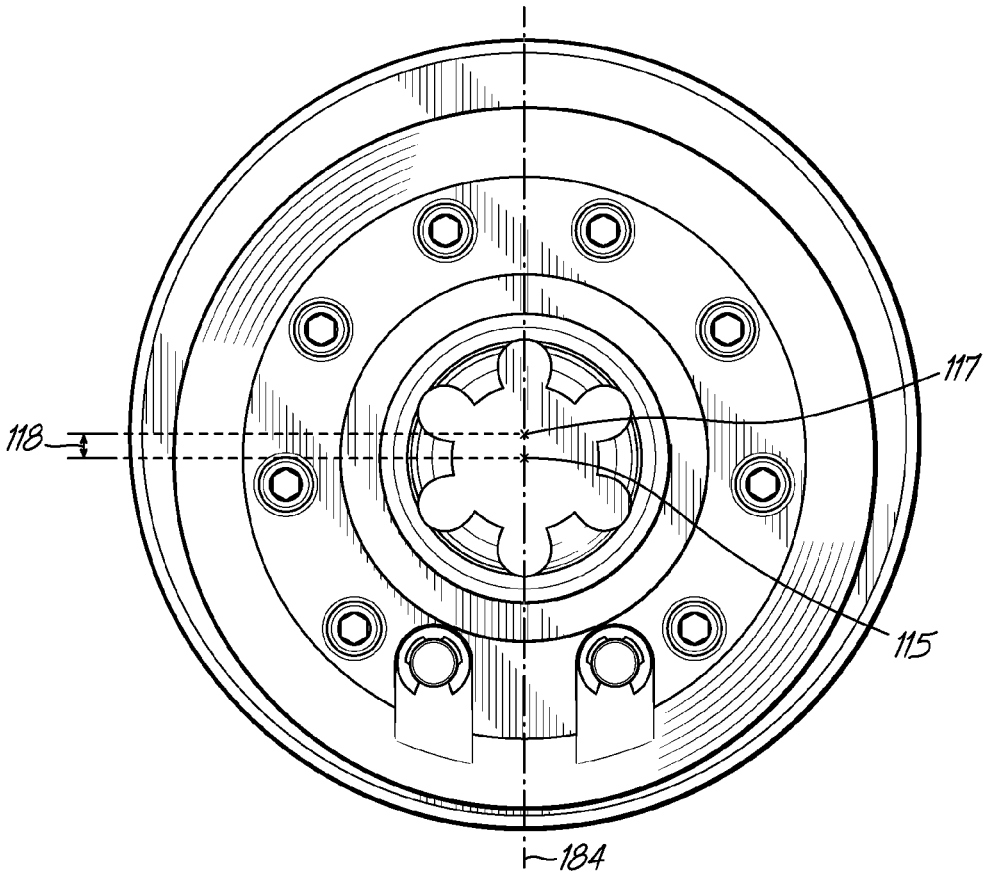
FIG. 15 is a right side elevational view of the workout bar.

Referring now to FIG. 15, workout bar 102 is configured to align strain gauge 180 with the primary forces exerted during exercise using workout bar 102. The alignment is generally along an imaginary line 184 extending orthogonally through the imaginary longitudinal axis 115 of the center beam 103 and the imaginary longitudinal axis 117 of the outer beam 111. System 101 is configured to orient imaginary line 184 generally in line with the force of gravity. When sitting at rest, and particularly when a weight stack is applied to outer beam 111, offset 118 between center beam 103 and outer beam 111 causes outer beam 111 to seek the lowest possible position relative to the center beam 103 due to gravitational forces pulling down on each element of the workout bar 102. As such, the cylindrical roller bearings 157 cooperate to allow interface disk 105 to axially rotate about center beam 103 to position the imaginary longitudinal axis 115 of outer beam 111 vertically below the imaginary longitudinal axis 117 of center beam 103. Further, the second set of rails 168 of outer disk 109 slide linearly with respect to the first set of rails 166 of inner disk 107 to position the strain gauge 180 directly in the path of the force vectors present during a pushing and pulling of the workout bar 102 during workout exercises.

Figure 16:
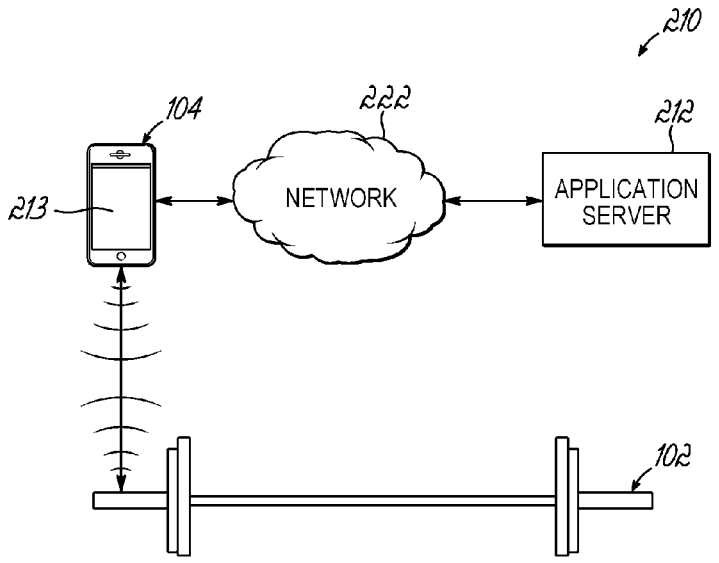
FIG. 16 is a diagrammatic view of an exemplary embodiment of an operating environment of the system, including an application server, the computing device, and the workout bar.

Referring now to FIG. 16, an operating environment 210 in accordance with an embodiment of the invention may include or reside within an application server 212, which may be located at a remote location. The application server 212 facilitates the coordination, storage, and retrieval of exercise data in an environment where the exercise data is not stored primarily on the computing device 104. The application server 212 can link data storage, information retrieval, calculation of workout metrics, and services, and provide the same to the end user through the computing device 104. In an exemplary embodiment of the workout bar 102, the workout bar 102 is configured for near field communication with the computing device 104, while computing device 104 may communicate with the application server 212 through a network 222. Network 222 may include one or more private or public networks (e.g. the Internet) that enable the exchange of data. As shown in FIG. 16, computing device 104 may communicate with the application server 212 through network 222.

Figure 17:
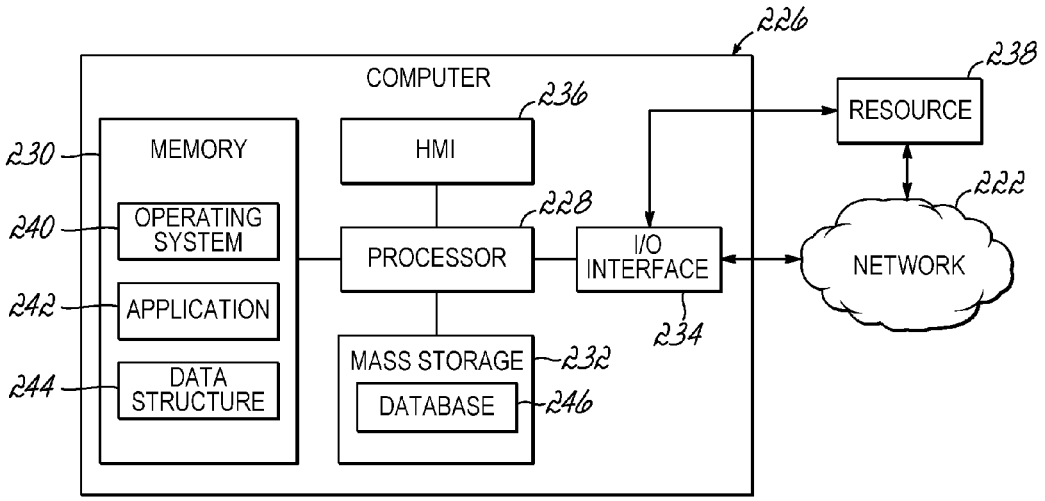
FIG. 17 is a diagrammatic view of an exemplary embodiment of a computer system of the operating environment.

Referring now to FIG. 17, the computing device 104 and application server 212 of operating environment 210 may be implemented on one or more computer devices or systems, such as exemplary computer system 226. The computer system 226 may include a processor 228, a memory 230, a mass storage memory device 232, an input/output (I/O) interface 234, and a Human Machine Interface (HMI) 236. The computer system 226 may also be operatively coupled to one or more external resources 238 via the network 222 or I/O interface 234. External resources may include, but are not limited to, servers, databases, mass storage devices, peripheral devices, cloud-based network services, or any other suitable computer resource that may used by the computer system 226.

The processor 228 may include one or more devices selected from microprocessors, micro-controllers, digital signal processors, microcomputers, central processing units, field programmable gate arrays, programmable logic devices, state machines, logic circuits, analog circuits, digital circuits, or any other devices that manipulate signals (analog or digital) based on operational instructions that are stored in the memory 230. Memory 230 may include a single memory device or a plurality of memory devices including, but not limited, to read-only memory (ROM), random access memory (RAM), volatile memory, non-volatile memory, static random access memory (SRAM), dynamic random access memory (DRAM), flash memory, cache memory, or any other device capable of storing information. The mass storage memory device 232 may include data storage devices such as a hard drive, optical drive, tape drive, non-volatile solid state device, or any other device capable of storing information.

Processor 228 may operate under the control of an operating system 240 that resides in memory 230. The operating system 240 may manage computer resources so that computer program code embodied as one or more computer software applications, such as an application 242 residing in memory 230, may have instructions executed by the processor 228. In an exemplary embodiment, the processor 228 may execute the application 242 directly, in which case the operating system 240 may be omitted. One or more data structures 244 may also reside in memory 230, and may be used by the processor 228, operating system 240, or application 242 to store or manipulate data.

The I/O interface 234 may provide a machine interface that operatively couples the processor 228 to other devices and systems, such as the network 222 or external resource 238. The application 242 may thereby work cooperatively with the network 222 or external resource 238 by communicating via the I/O interface 234 to provide the various features, functions, applications, processes, or modules comprising embodiments of the invention. The application 242 may also have program code that is executed by one or more external resources 238, or otherwise rely on functions or signals provided by other system or network components external to the computer system 226. Indeed, given the nearly endless hardware and software configurations possible, persons having ordinary skill in the art will understand that embodiments of the invention may include applications that are located externally to the computer system 226, distributed among multiple computers or other external resources 238, or provided by computing resources (hardware and software) that are provided as a service over the network 222, such as a cloud computing service.

The HMI 236 may be operatively coupled to the processor 228 of computer system 226 in a known manner to allow a user to interact directly with the computer system 226. The HMI 236 may include video or alphanumeric displays, a touch screen, a speaker, and any other suitable audio and visual indicators capable of providing data to the user. The HMI 236 may also include input devices and controls such as an alphanumeric keyboard, a pointing device, keypads, pushbuttons, control knobs, microphones, etc., capable of accepting commands or input from the user and transmitting the entered input to the processor 228.

A database 246 may reside on the mass storage memory device 232, and may be used to collect and organize data used by the various systems and modules described herein. The database 246 may include data and supporting data structures that store and organize the data. In particular, the database 246 may be arranged with any database organization or structure including, but not limited to, a relational database, a hierarchical database, a network database, or combinations thereof. A database management system in the form of a computer software application executing as instructions on the processor 228 may be used to access the information or data stored in records of the database 246 in response to a query, where a query may be dynamically determined and executed by the operating system 240, other applications 242, or one or more modules. In an exemplary embodiment of the invention, the database 246 may comprise a workout database 248 (FIG. 18) containing exercise data that provides information relating to one or more exercise or workout routines captured thereby, information regarding the fitness or metrics of the user such as weight or height, and authentication information for the user such as a login ID and password.

Referring now to FIG. 1, the application server 212 may coordinate with or utilize information stored or provided by one or more of the workout bar 102, the computing device 104, or any other suitable computer system, or any combination thereof. In general, the application server 212 is configured to receive, store, and provide access to stored exercise data generated via the workout bar 102, the computing device 104, or a combination thereof. For example, the data elements available to the application server 212 may include the workout participant's name, login information, height, weight, and workout repetitions performed at particular weight at a particular time.

Figure 18:
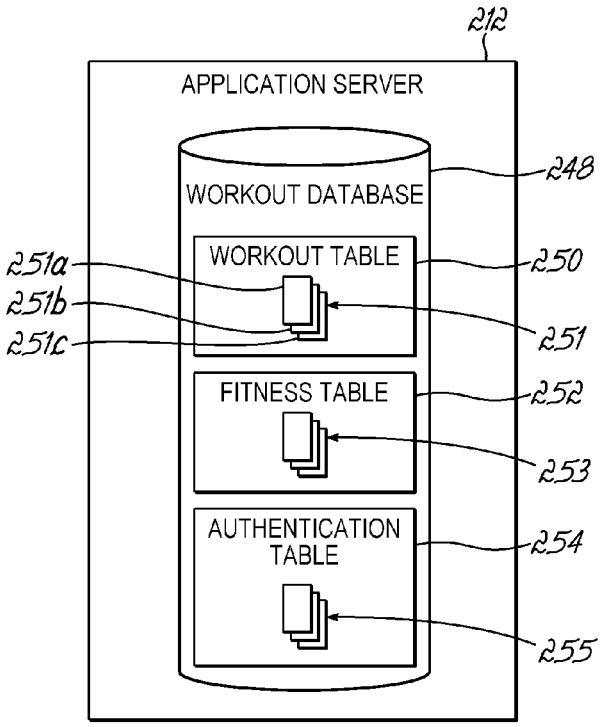
FIG. 18 is a schematic view of an exemplary embodiment of the application server, including a workout database having a workout table, a fitness table, and an authentication table.

Referring now to FIG. 18, the workout database 248 may include a workout table 250, a fitness table 252, and an authentication table 254. Fitness table 252 may include fitness records 253 for storing information regarding the fitness of a particular user. For example, each fitness record 253 may include information such as calculated body mass index, current and historical body weight, and current and historical height. Authentication table 254 may include authentication records 255 for storing information regarding logging into interface 213. For example, each authentication record 255 may include information such as a user identification and a user password. When a user attempts to log into interface 213, application server 212 provides the corresponding stored user identification and password to determine whether the user entered the correct information.

Figure 19:
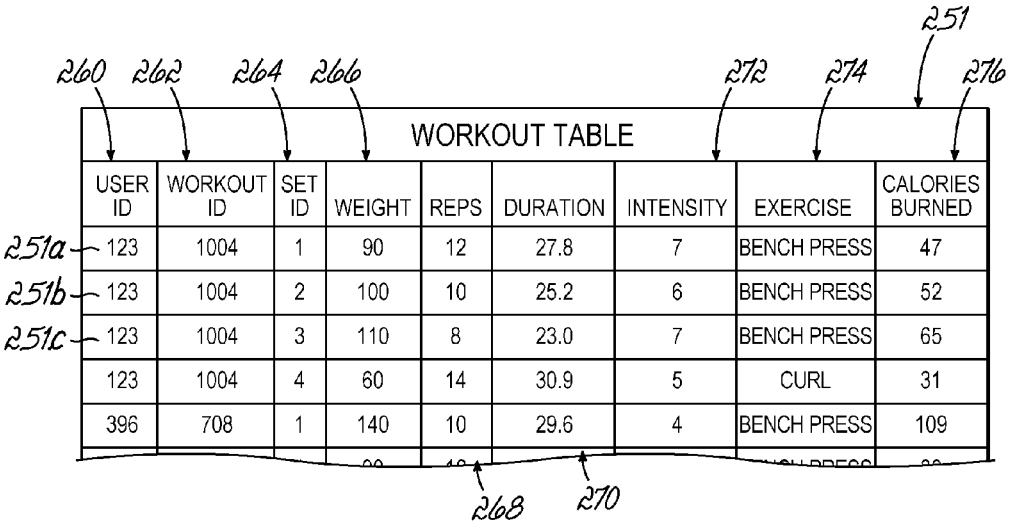
FIG. 19 is a graphical view of an exemplary embodiment of the workout table.

Referring now to FIGS. 18 and 19, the workout database 248 includes workout table 250. Workout table 250 may include workout records 251 for storing and referencing workout or exercise data or information stored therein. The data may be used in providing historical workout data, present workout data, or a combination thereof to the user. The exercise data stored in workout table 250 may be generated by workout bar 102 and may be provided to application server 212 through computing device 104 and network 222. A pseudo-database table representing workout table 250 is shown in FIG. 19 and may include multiple rows, each representing a workout record 251, such as workout records 251A, 251B, and 251C. Each workout record 251 includes a set of metrics or data generated during the performance of a particular exercise. For exemplary purposes, each workout row 251 shown in FIG. 19 includes a user ID field 260, a workout ID field 262, a set ID field 264, a weight field 266, a reps field 268, a duration field 270, an intensity field 272, an exercise field 274, and a calories burned field 276.

User ID field 260 contains a reference identifier to a particular user of the overall system. This field may be a reference key referring to another table in application server 212. For example, the values found in User ID field 260 may correspond or reference a user row in authentication table 254. Workout ID field 262 includes a reference identifier to a particular workout. Similarly, set ID field 264 contains a reference identifier to a particular set within the workout identified in workout ID field 262. Weight field 266 includes information regard how much the workout bar 102 and the applied weight disks weighed during the set identified in set ID 264. Reps field 268 includes information regarding how many repetitions were performed in the set identified in set ID 264. Duration field 270 includes information regarding how long the user took to perform all the reps in the set. Intensity field 272 includes information regarding how intense the repetitions of the set were performed. This information may be derived from information contained in the respective weight field 266, reps field 268, and duration field 270. For example, a function may be provided which inputs the weight, repetitions, and duration of a set and derives the relative intensity. This derivation may be stored in intensity field 272. Alternative, given the relevant information is stored in weight field 266, reps field 268, and duration field 270, the intensity may be derived dynamically as required by system 101.

Exercise field 274 includes information regarding the exercise performed during the respective set. For example, the set may be a bench press whereby the user loads weight onto workout bar 102 and performs a bench press exercise. As shown in workout record 251A, the user performed a bench press exercise with an overall weight of 90 pounds for a total of 12 repetitions for a total duration of 27.8 seconds. As such, this set 264A was performed with a relative intensity of 7.

Calories burned field 276 includes information regarding the calculated amount of calories the user burned by performing the exercise represented in the respective workout record 251. The values provided in calories burned field 276 are derived from collected data such as the user's weight and height, as well as the amount of weight used during the exercise, the repetitions, the duration, the intensity, and the particular exercise performed. For example, system 101 calculated that the user burned 52 calories while performing the exercise represented in workout table 251B.

Figure 20:
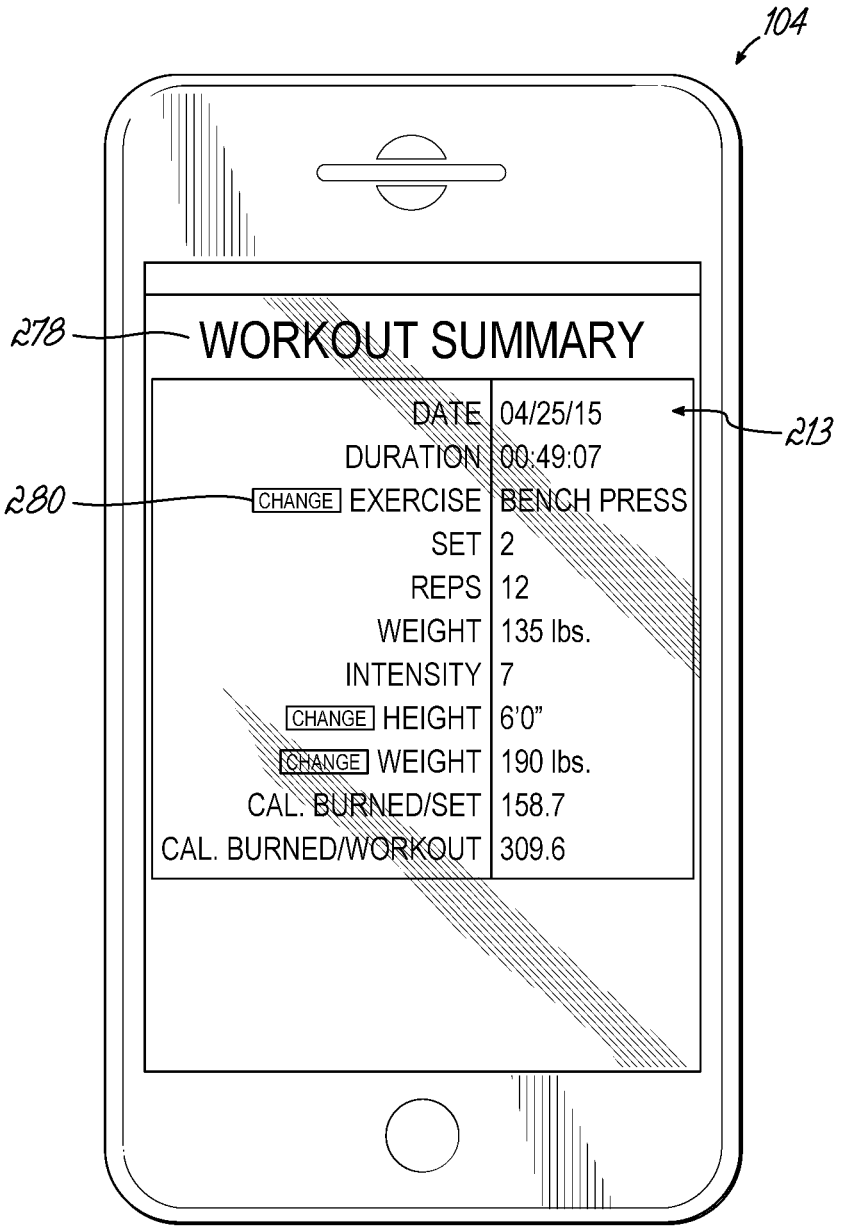
FIG. 20 is a graphical view of an exemplary embodiment of a user interface and a display of the computing device.

As shown in FIG. 20, the data contained within workout table 250 may be provided to the user through interface 213 of computing device 104. For example, a workout summary 278 may be provided through interface 213 whereby the values stored in one or more workout records 251, an accumulation thereof, or a transformation thereof, are provided to the user as feedback regarding a particular workout. For example, the values stored in set ID field 264, weight field 266, reps field 268, duration field 270, intensity field 272, exercise field 274, and calories burned field 276 may be provided to the user through workout summary 278 of interface 213. Prior to a set or workout, the user may actuate portions of workout summary 278 or interface 213, such as by actuating button 280, to configure or update the information regarding a particular workout. For example, the user may actuate button 280 to change the exercise from "bench press" to "curls" to signify that the exercise performed or about to be performed in a curl exercise.

In operation, a user selects a workout bar 102 and applies one or more weight disks on the outer beam 111. The user grasps and lifts center beam 103 to perform an exercise using the workout bar 102, for example a bench press exercise. Upon lift center beam 103, each end of center beam 103 within sleeve 120 of inner disk 107 and inner disk 107 rotates axially with respect to one another due to the weight of outer beam 111. The axial rotation positions imaginary longitudinal axis 115 of outer beam vertically below the imaginary longitudinal axis 117 of center beam 103, shown as offset 118. Similarly, the sensor, shown in FIG. 11 as strain gauge 180, is positioned along the imaginary line extending orthogonally through axis 115 and axis 117. The weight of outer beam 111 presses downwardly in the direction of Arrow A of FIG. 11 and increases pressure, tension, strain, or a combination thereof on strain gauge 180 due to the downward force of measurement bridge 172 on second block 182. Sensor assembly 119 captures the exercise data regarding the weight on outer beam 111 provided by strain gauge 180. Each time a user lowers and raises the workout bar 102 to perform a repetition of the bench press exercise (up and down), the strain gauge 180 increases and decreases the overall exercise data regarding the weight of outer beam 111, which signifies to the sensor assembly 119 that a repetition has been performed. The sensor assembly 119 captures the exercise data regarding the repetitions provided by strain gauge 180. The collected exercise data is transferred wirelessly to computing device 104 for later use by the user. The computing device 104 may further be configured to transmit the exercise data to the application server 212 for storage and retrieval by the user through the computing device 104.

While application server 212 is shown and described herein, in a different exemplary embodiment of system 101, system 101 may include some or all of the functions provided by application server 212 in a workout application residing on the computing device 104. For example, the workout database 248 or components thereof may reside locally on computing device 104 and may store only the particular user's workout metrics and exercise data. As such, any features described or contemplated with respect to system 101 may be provided in either a local application running on computing device 104, application server 212, or a combination thereof.

Various program code described herein may be identified based upon the application within which it is implemented in specific embodiments of the invention. However, it should be appreciated that any particular program nomenclature that follows is used merely for convenience, and thus the invention should not be limited to use solely in any specific application identified and/or implied by such nomenclature. Furthermore, given the generally endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the embodiments of the invention are not limited to the specific organization and allocation of program functionality described herein.

The program code embodied in any of the applications/modules described herein is capable of being individually or collectively distributed as a program product in a variety of different forms. In particular, the program code may be distributed using a computer readable storage medium having computer readable program instructions thereon for causing a processor to carry out aspects of the embodiments of the invention.

Computer readable storage media, which is inherently non-transitory, may include volatile and non-volatile, and removable and non-removable tangible media implemented in any method or technology for storage of information, such as computer-readable instructions, data structures, program modules, or other data. Computer readable storage media may further include RAM, ROM, erasable programmable read-only memory (EPROM), electrically erasable programmable read-only memory (EEPROM), flash memory or other solid state memory technology, portable compact disc read-only memory (CD-ROM), or other optical storage, magnetic cassettes, magnetic tape, magnetic disk storage or other magnetic storage devices, or any other medium that can be used to store the desired information and which can be read by a computer. A computer readable storage medium should not be construed as transitory signals per se (e.g., radio waves or other propagating electromagnetic waves, electromagnetic waves propagating through a transmission media such as a waveguide, or electrical signals transmitted through a wire). Computer readable program instructions may be downloaded to a computer, another type of programmable data processing apparatus, or another device from a computer readable storage medium or to an external computer or external storage device via a network.

Computer readable program instructions stored in a computer readable medium may be used to direct a computer, other types of programmable data processing apparatus, or other devices to function in a particular manner, such that the instructions stored in the computer readable medium produce an article of manufacture including instructions that implement the functions, acts, and/or operations specified in the flowcharts, sequence diagrams, and/or block diagrams. The computer program instructions may be provided to one or more processors of a general purpose computer, a special purpose computer, or other programmable data processing apparatus to produce a machine, such that the instructions, which execute via the one or more processors, cause a series of computations to be performed to implement the functions, acts, and/or operations specified in the flowcharts, sequence diagrams, and/or block diagrams.

In certain alternative embodiments, the functions, acts, and/or operations specified in the flowcharts, sequence diagrams, and/or block diagrams may be re-ordered, processed serially, and/or processed concurrently consistent with embodiments of the invention. Moreover, any of the flowcharts, sequence diagrams, and/or block diagrams may include more or fewer blocks than those illustrated consistent with embodiments of the invention.

The terminology used herein is for the purpose of describing particular embodiments only and is not intended to be limiting of the embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Furthermore, to the extent that the terms "includes", "having", "has", "with", "comprised of", or variants thereof are used in either the detailed description or the claims, such terms are intended to be inclusive in a manner similar to the term "comprising".

While all of the invention has been illustrated by a description of various embodiments and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicant's general inventive concept.

The invention claimed is:

1. A method for capturing exercise data, the method comprising:

offsetting an imaginary longitudinal axis of a center beam of a workout bar and an imaginary longitudinal axis of an outer beam of the workout bar;

sensing, dynamically by a sensor, an amount of weight disposed on the outer beam; and communicating the amount of weight wirelessly to a computing device.

2. The method of claim 1 further comprising:

disposing an interface disk between the center beam and the outer beam.

3. The method of claim 2 further comprising:

securing the center beam to an inner disk of the interface disk;

securing the outer beam to an outer disk of the interface disk; and moving the inner disk, the outer disk, or a combination thereof, to offset the imaginary longitudinal axis of the center beam and the imaginary longitudinal axis of the outer beam.

4. The method of claim 3 further comprising:

rotating the inner disk axially with respect to the center beam.

5. The method of claim 4 further comprising:

moving the outer disk linearly with respect to the inner disk.

6. The method of claim 1 further comprising:

securing the sensor to a first block of the workout bar; and abutting the first block with a second block of the workout bar to stimulate the sensor.

7. The method of claim 6 further comprising:

securing the first block to one of the inner interface disk and the outer interface disk;

securing the second block to the other of the inner interface disk and the outer interface disk; and moving the first block linearly with respect to the second block to abut the first block and the second block.

8. The method of claim 7 wherein the sensor comprises a strain gauge and further comprising:

stressing the strain gauge to sense the amount of weight.

9. The method of claim 1 further comprising:

an imaginary line extending orthogonally through the imaginary longitudinal axis of the center beam and the imaginary longitudinal axis of the outer beam; and disposing the sensor along the imaginary line.

10. The method of claim 1 further comprising:

communicating the amount of weight to an application server.

11. The method of claim 1 further comprising:

sensing, by the sensor, an amount of exercise repetitions performed using the workout bar; and communicating the amount of exercise repetitions wirelessly to the computing device.

12. The method of claim 11 further comprising:

communicating the amount of weight and the amount of exercise repetitions to an application server.

13. The method of 1 further comprising:

rotating the outer beam axially with respect to the center beam; and moving the outer beam linearly with respect to the center beam.

14. The method of claim 1 further comprising:

abutting a first block associated with the outer beam with a second block associated with the center beam; and sensing the amount of weight disposed on the outer beam by measuring a pressure on one of the first block and the second block, a strain on one of the first block and the second block, a tension on one of the first block and the second block, or a combination thereof.

* * * * *